US012678698B1

(12) United States Patent
Taylor

(10) Patent No.: US 12,678,698 B1
(45) Date of Patent: Jul. 14, 2026

(54) HUGGING THERAPY DOLL

(71) Applicant: Debra G. Taylor, Richmond, VA (US)

(72) Inventor: Debra G. Taylor, Richmond, VA (US)

( * ) Notice: Subject to any disclaimer, the term of this patent is extended or adjusted under 35 U.S.C. 154(b) by 259 days.

(21) Appl. No.: 18/520,765

(22) Filed: Nov. 28, 2023

(51) Int. Cl.
*A63H 3/00* (2006.01)
*A63H 3/46* (2006.01)
*A63H 3/50* (2006.01)

(52) U.S. Cl.
CPC ..... *A63H 3/003* (2013.01); *A63H 3/46* (2013.01); *A63H 3/50* (2013.01)

(58) Field of Classification Search
CPC ..... A63H 3/00–52
See application file for complete search history.

(56) References Cited

U.S. PATENT DOCUMENTS 1,800,775 A * 4/1931 Bostwick ..... A63H 3/20 446/298
2,137,371 A * 11/1938 Marsh ..... A63H 3/20 446/330
2,614,365 A * 10/1952 Musselwhite ..... A63H 3/46 446/330
2,669,064 A * 2/1954 Stewart ..... A63H 3/20 446/330
2,754,121 A * 7/1956 Jupiter ..... A63H 3/02 446/26
3,053,008 A * 9/1962 Pelunis ..... A63H 13/00 446/330
3,125,828 A * 3/1964 Ostrander ..... A63H 3/48 446/330
3,634,966 A * 1/1972 Ostrander ..... A63H 3/46 446/380
3,699,713 A * 10/1972 Sapkus ..... A63H 3/48 446/330
3,758,982 A * 9/1973 Lemelson ..... A63H 13/00 446/365
3,775,900 A * 12/1973 Thorn ..... A63H 3/48 446/354
3,874,112 A * 4/1975 Sapkus ..... A63H 13/12 446/268
3,906,661 A * 9/1975 Weiser ..... A63H 3/20 446/336

(Continued)

FOREIGN PATENT DOCUMENTS

GB 2437260 12/2010

*Primary Examiner* — Michael D Dennis
*Assistant Examiner* — Matthew B Stanczak

(57) ABSTRACT

The hugging therapy doll is a therapeutic structure, which is an emotional support doll. The hugging therapy doll is formed in the image of a human being. The hugging therapy doll gives a patient a hug. The hugging therapy doll includes a head structure, a torso structure, a pelvic structure, a plurality of simulated appendage structures, a plurality of joints, a plurality of telescopic knee structures, a shoulder lever structure, and a simulated skin structure. The plurality of joints and the plurality of telescopic knee structures assemble the head structure, the torso structure, the pelvic structure, and the plurality of simulated appendage structures into a figurine that presents the sentiment of a human being. The shoulder lever structure mounts in the torso structure. The simulated skin structure encloses the exterior surfaces of the figurine formed by the hugging therapy doll.

9 Claims, 6 Drawing Sheets

(56) References Cited

U.S. PATENT DOCUMENTS 3,988,855 A * 11/1976 Crabtree ..... A63H 3/46 446/380
4,126,961 A * 11/1978 Barlow ..... A63H 3/20 446/359
4,212,132 A * 7/1980 Lewanoni ..... A63H 3/31 446/185
4,476,650 A * 10/1984 Lokvig ..... A63H 3/14 446/362
4,601,671 A * 7/1986 DeMars ..... A63H 3/20 446/330
4,630,762 A * 12/1986 Stringer ..... A47F 8/02 D21/627
4,643,694 A * 2/1987 Phibbs ..... A63H 3/14 446/329
4,759,737 A * 7/1988 Ferenczi ..... A63H 3/20 446/183
4,810,227 A * 3/1989 Kim ..... A63H 3/48 446/354
5,017,173 A * 5/1991 Shapero ..... A63H 3/46 446/374
5,046,987 A * 9/1991 Djordjevic ..... A63H 13/06 446/365
5,071,387 A * 12/1991 Pottick ..... A63H 33/28 446/268
5,257,873 A * 11/1993 Abbat ..... A63H 3/46 446/376
5,378,188 A * 1/1995 Clark ..... A63H 3/20 446/361
5,470,270 A * 11/1995 Beamon, Jr. ..... A63H 3/20 446/330
5,588,895 A * 12/1996 Larson ..... A63H 3/00 446/376
5,651,717 A * 7/1997 Hamilton ..... A63H 3/48 446/362
5,785,575 A * 7/1998 Llorens ..... A63H 3/20 446/365
6,110,002 A * 8/2000 Langton ..... A63H 3/04 446/373
6,200,190 B1 * 3/2001 Reynolds ..... A63H 3/20 446/376
6,224,456 B1 * 5/2001 Wittenberg ..... A63H 3/46 446/376
6,257,467 B1 * 7/2001 Chen ..... A47F 8/00 223/66
6,805,606 B1 * 10/2004 Kellum ..... A63H 3/36 92/92
7,410,403 B1 8/2008 Altschul
D622,332 S 8/2010 Pence
7,934,973 B2 * 5/2011 Trageser ..... A63H 3/46 446/180
8,308,524 B2 * 11/2012 deFelice ..... A63H 3/20 446/375
9,370,723 B2 * 6/2016 Lau ..... A63H 3/20
9,707,487 B2 * 7/2017 Chan ..... A63H 13/06
9,919,230 B2 * 3/2018 Li ..... A63H 9/00
11,235,253 B2 * 2/2022 Towne ..... A63H 3/36
11,566,659 B2 * 1/2023 Moffatt ..... A63H 3/46
2004/0082265 A1 * 4/2004 Langton ..... A63H 3/46 446/373
2005/0051581 A1 * 3/2005 Nan ..... A47F 8/00 223/67
2007/0238387 A1 * 10/2007 Sutton ..... A63H 3/14 446/369
2008/0296321 A1 * 12/2008 Polins ..... A47F 8/00 223/66
2011/0003529 A1 * 1/2011 Ehrsam ..... A63H 33/26 446/376
2013/0186922 A1 * 7/2013 Soto Velasco ..... A47F 8/02 223/66
2014/0370779 A1 12/2014 Simonds
2015/0174500 A1 * 6/2015 Beglan ..... A63H 13/00 74/490.04
2015/0188233 A1 * 7/2015 Chen ..... H01Q 1/526 342/5
2017/0181553 A1 * 6/2017 Tiggett, Jr. ..... A47F 8/00
2022/0026183 A1 * 1/2022 Amman ..... F16C 11/04
2022/0176266 A1 * 6/2022 Eck ..... A63J 1/02
2023/0390656 A1 * 12/2023 Hsu ..... A63H 3/02
2023/0405483 A1 * 12/2023 Hsu ..... A63H 3/02
2024/0189726 A1 * 6/2024 Vang ..... A63H 3/003
2024/0221540 A1 * 7/2024 Boissy ..... G09B 23/288

* cited by examiner

HUGGING THERAPY DOLL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of therapeutic dolls. (A63H3/00)

SUMMARY OF INVENTION

The hugging therapy doll is a therapeutic structure. The hugging therapy doll is adapted for use with a patient. The hugging therapy doll is an emotional support doll. The hugging therapy doll is formed in the image of a human being. The hugging therapy doll gives the patient a hug. The hugging therapy doll comprises a head structure, a torso structure, a pelvic structure, a plurality of simulated appendage structures, a plurality of joints, a plurality of telescopic knee structures, a shoulder lever structure, and a simulated skin structure. The plurality of joints and the plurality of telescopic knee structures assemble the head structure, the torso structure, the pelvic structure, and the plurality of simulated appendage structures into a figurine that presents the sentiment of a human being. The shoulder lever structure mounts in the torso structure. The simulated skin structure encloses the exterior surfaces of the figurine formed by the hugging therapy doll.

These together with additional objects, features and advantages of the hugging therapy doll will be readily apparent to those of ordinary skill in the art upon reading the following detailed description of the presently preferred, but nonetheless illustrative, embodiments when taken in conjunction with the accompanying drawings.

In this respect, before explaining the current embodiments of the hugging therapy doll in detail, it is to be understood that the hugging therapy doll is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hugging therapy doll.

It is therefore important that the claims be regarded as including such equivalent construction insofar as they do not depart from the spirit and scope of the hugging therapy doll. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
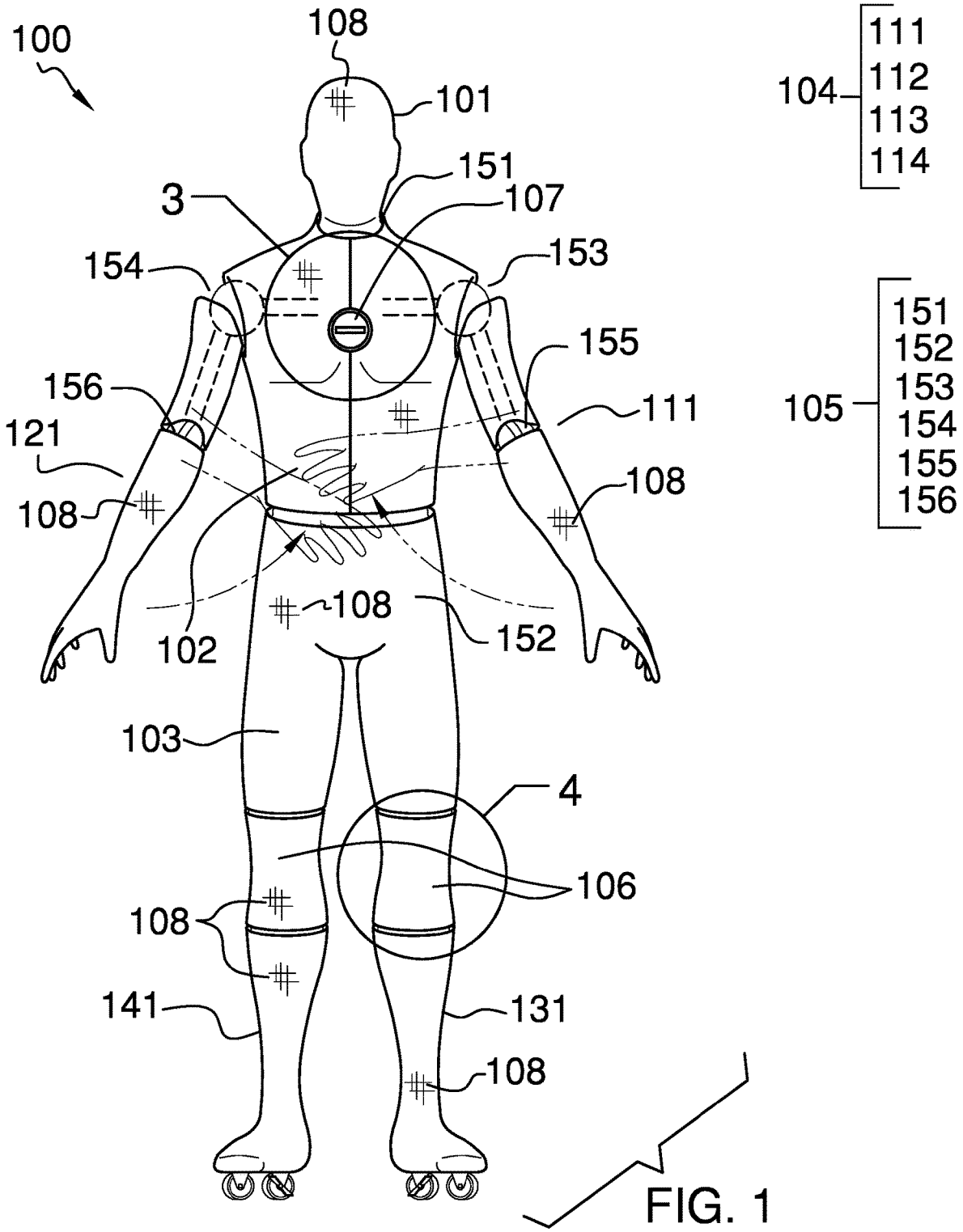
FIG. 1 is a front view of an embodiment of the disclosure.
Figure 2:
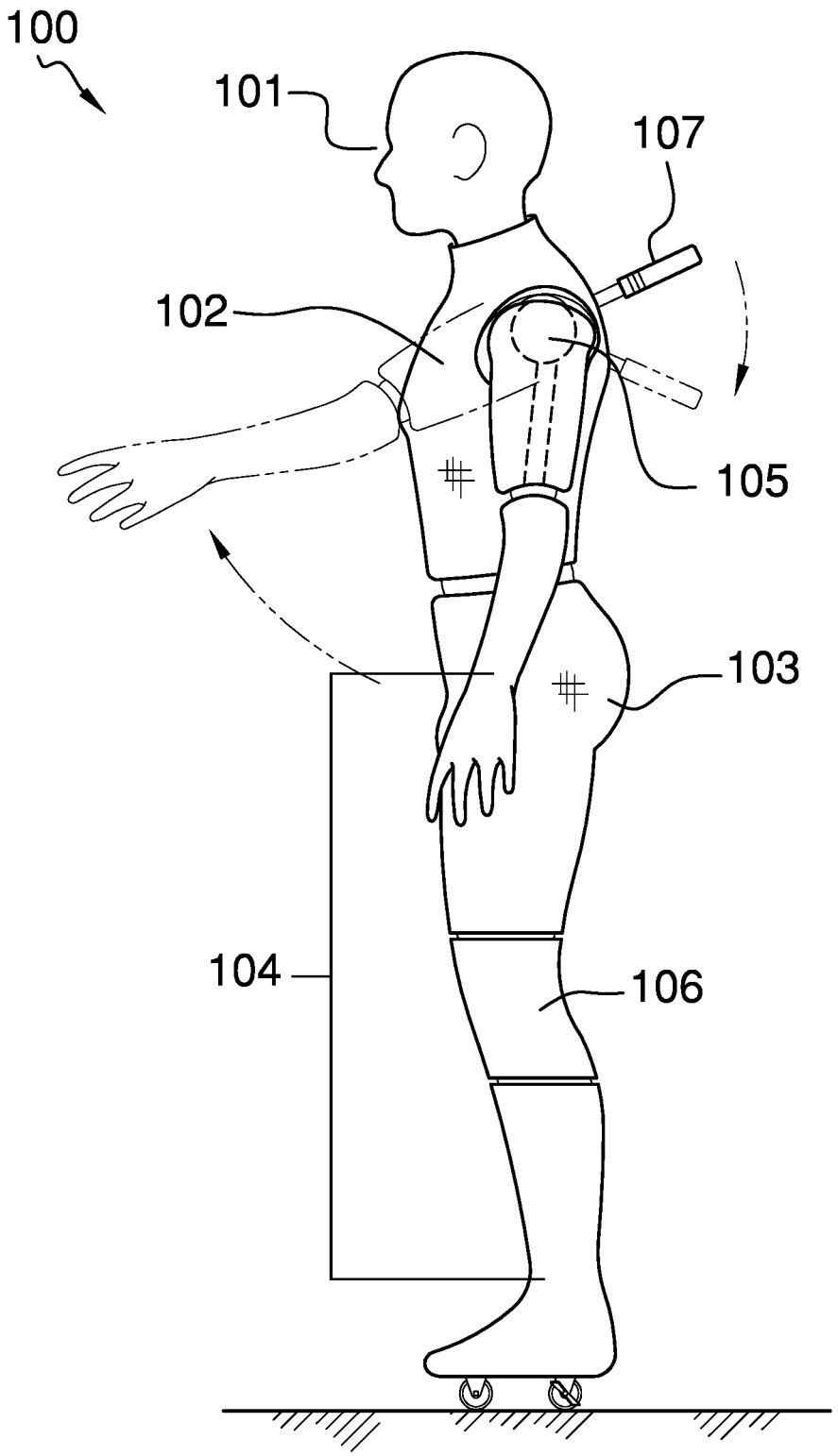
FIG. 2 is a side view of an embodiment of the disclosure.
Figure 3:
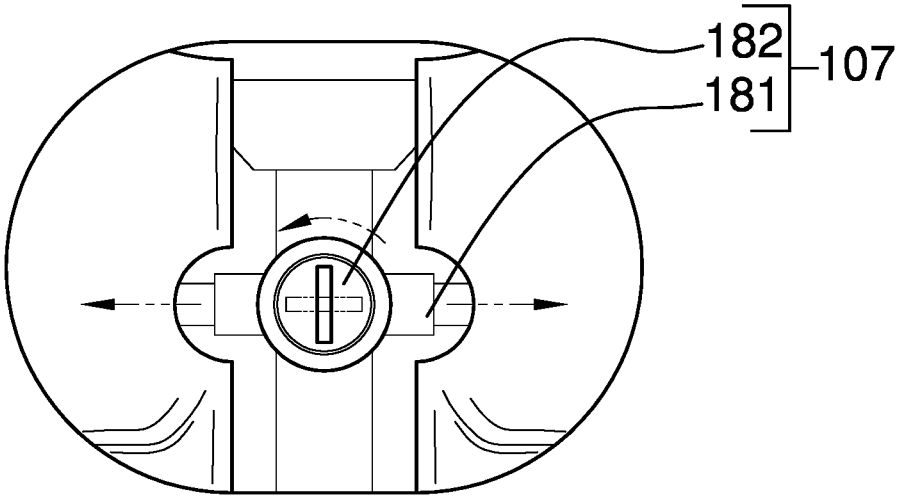
FIG. 3 is a detail view of an embodiment of the disclosure.
Figure 4:
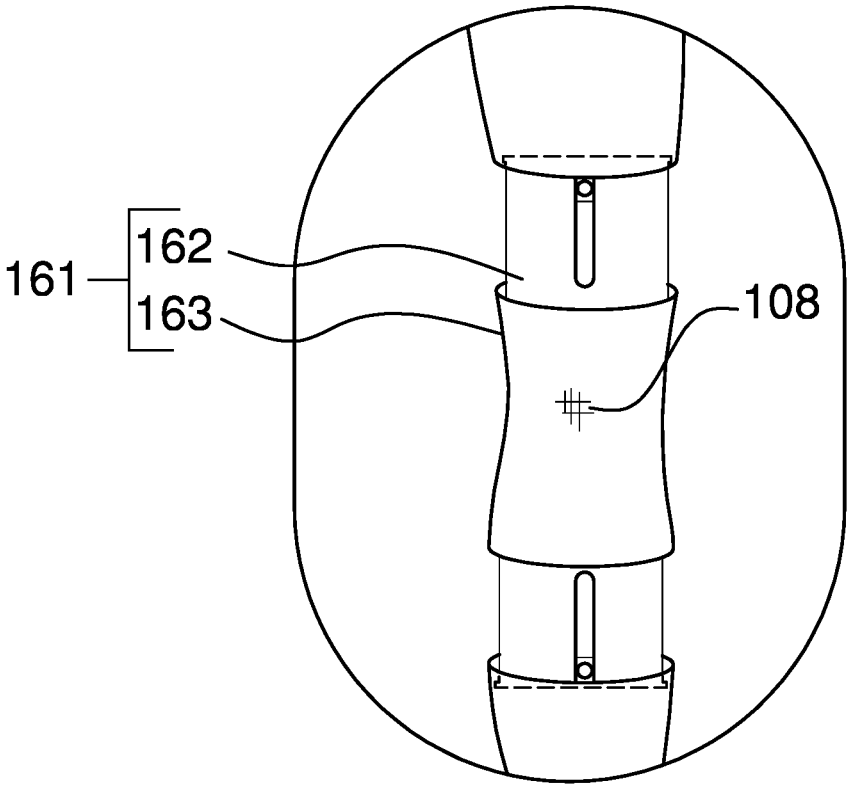
FIG. 4 is a detail view of an embodiment of the disclosure.
Figure 5:
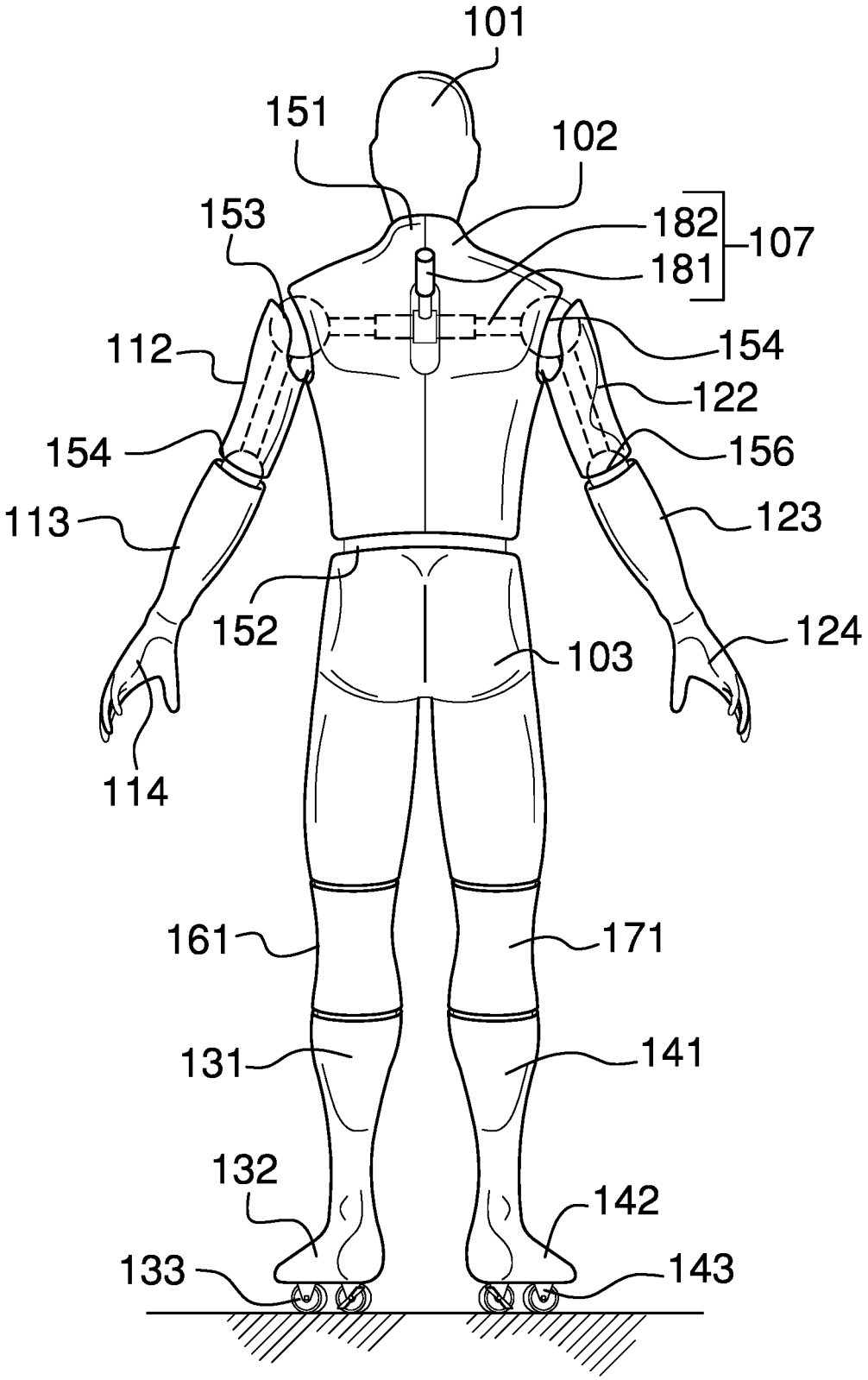
FIG. 5 is a rear view of an embodiment of the disclosure.
Figure 6:
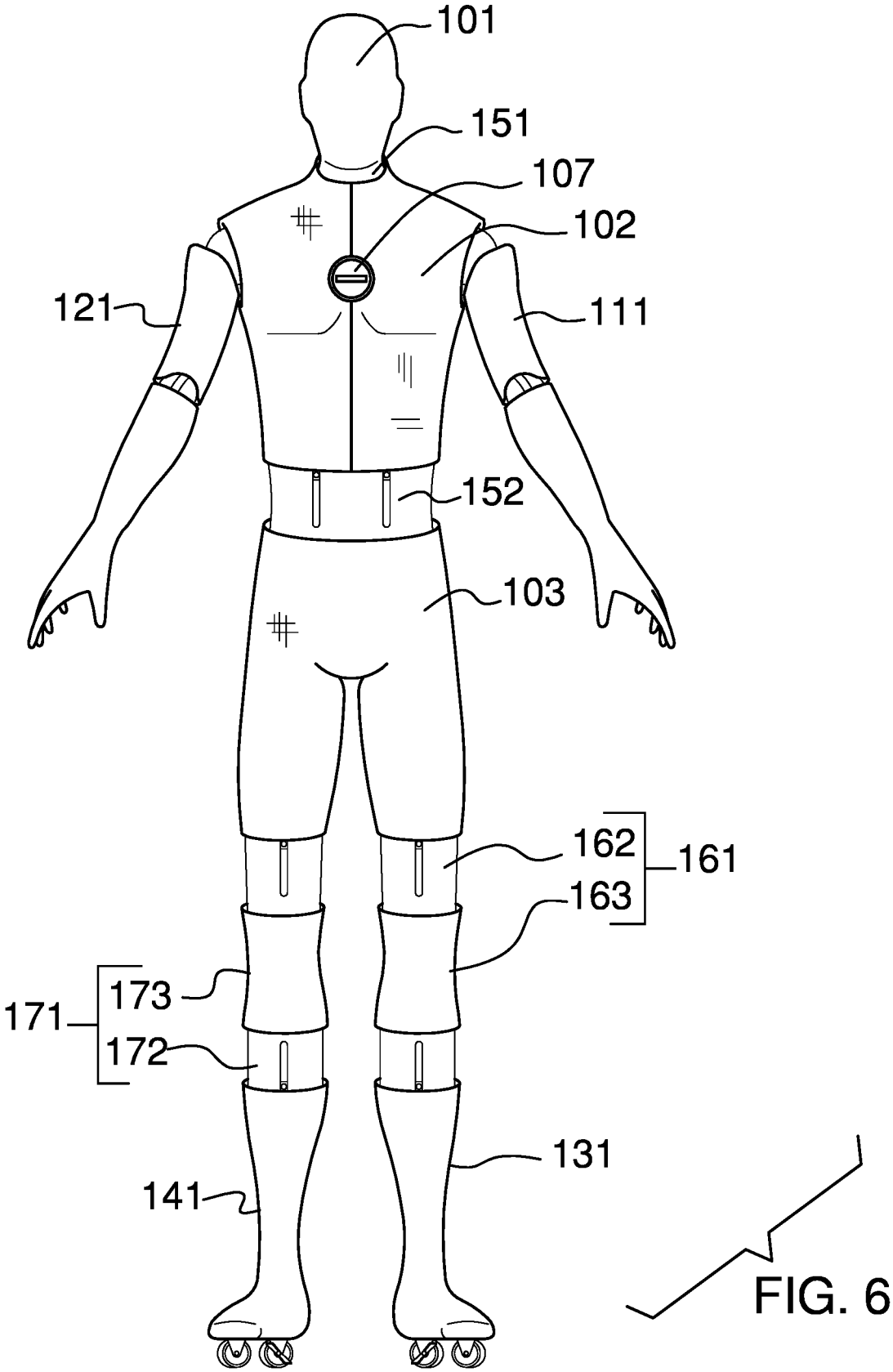
FIG. 6 is a front view of an embodiment of the disclosure.
Figure 7:
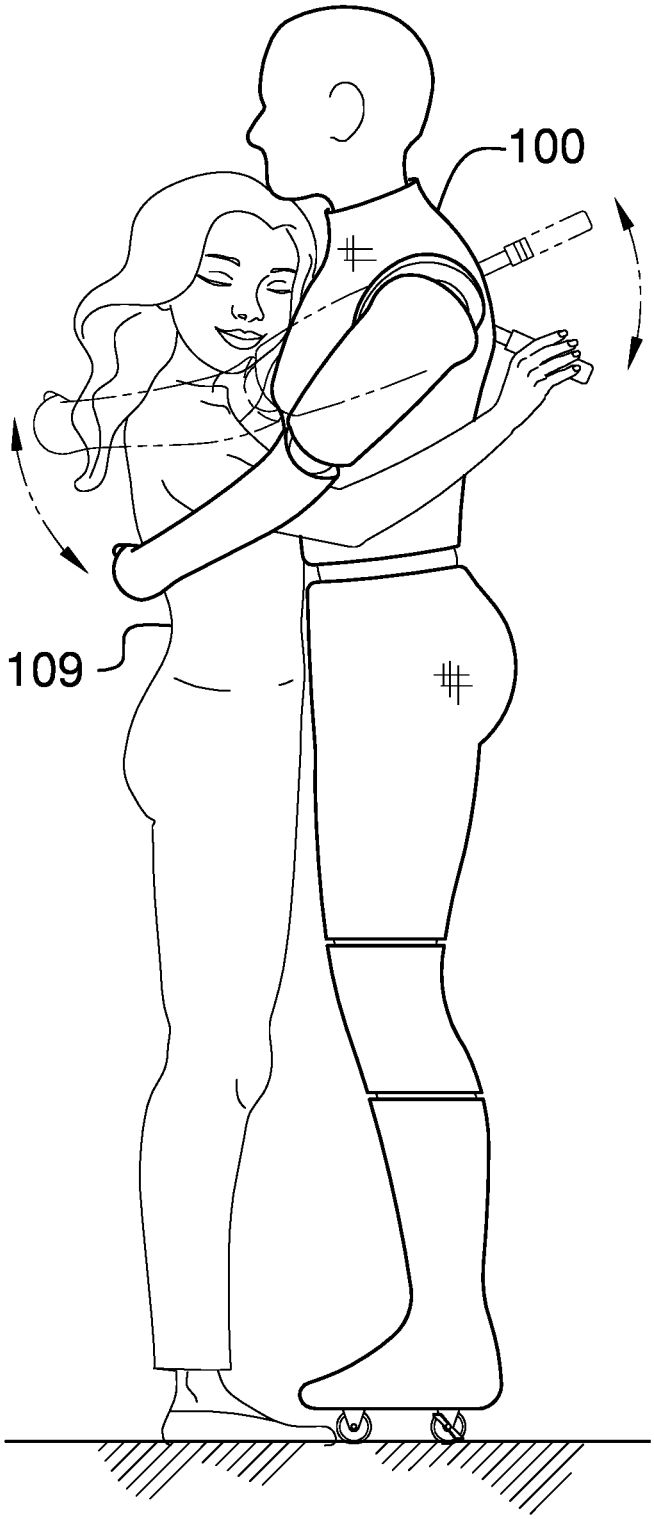
FIG. 7 is an in-use view of an embodiment wherein the user manually rotates a handle of the shoulder lever structure that is extending solely form a rear of the torso structure.

Detailed reference will now be made to one or more potential embodiments of the disclosure, which are illustrated in FIGS. 1 through 7.

The hugging therapy doll 100 (hereinafter invention) is a therapeutic structure. The invention 100 is adapted for use with a patient 109. The invention 100 is an emotional support doll. The invention 100 is formed in the image of a human being. The invention 100 gives the patient 109 a hug. The invention 100 comprises a head structure 101, a torso structure 102, a pelvic structure 103, a plurality of simulated appendage structures 104, a plurality of joints 105, a plurality of telescopic knee structures 106, a shoulder lever structure 107, and a simulated skin structure 108. The plurality of joints 105 and the plurality of telescopic knee structures 106 assemble the head structure 101, the torso structure 102, the pelvic structure 103, and the plurality of simulated appendage structures 104 into a figurine that presents the sentiment of a human being. The shoulder lever structure 107 mounts in the torso structure 102. The simulated skin structure 108 encloses the exterior surfaces of the figurine formed by the invention 100.

The patient 109 is the individual designated to receive the services of the invention 100.

The simulated skin structure 108 is a cushioned surface that encloses the exterior surfaces of the figurine structure formed by the invention 100. The appearance, texture, and feel of the simulated skin structure 108 simulates the tactile properties of the skin of a human being. The simulated skin structure 108 coats the exterior surfaces of the head structure 101. The simulated skin structure 108 coats the exterior surfaces of the torso structure 102. The simulated skin structure 108 coats the exterior surfaces of the pelvic structure 103. The simulated skin structure 108 coats the exterior surfaces of each simulated appendage structure selected from the plurality of simulated appendage structures 104. The simulated skin structure 108 coats the exterior surfaces of the shell structure of each telescopic knee structure selected from the plurality of telescopic knee structures 106.

The head structure 101 is a mechanical structure. The appearance of the head structure 101 generates the sentiment of the head of a human being. The torso structure 102 is a mechanical structure. The appearance of the torso structure 102 generates the sentiment of the torso of a human being. The pelvic structure 103 is a mechanical structure. The appearance of the pelvic structure 103 generates the sentiment of the pelvis of a human being.

Each simulated appendage structure selected from the plurality of simulated appendage structures 104 attaches to a structure selected from the group consisting of the head structure 101 and the torso structure 102. Each simulated appendage structure selected from the plurality of simulated appendage structures 104 attaches to its selected structure such that the selected simulated appendage structure rotates relative to the selected structure. The appearance of each simulated appendage structure selected from the plurality of simulated appendage structures 104 generates the sentiment of the appendage of a human being. The plurality of simulated appendage structures 104 comprises a left simulated arm structure 111, a right simulated arm structure 121, a left simulated leg structure 131, and a right simulated leg structure 141.

The left simulated arm structure 111 has the rough primary shape of a composite prism. The left simulated arm structure 111 attaches to the left shoulder region of the torso structure such that the left simulated arm structure 111 rotates relative to the torso structure 102. The left simulated arm structure 111 generates the sentiment of the left arm of a human being. The left simulated arm structure 111 further comprises a left simulated upper arm 112 and a left simulated lower arm 113, and a left simulated hand 114.

The left simulated upper arm 112 is the structure of the left simulated arm structure 111 that attaches the left simulated lower arm 113 to the torso structure 102. The left simulated lower arm 113 is the structure of the left simulated arm structure 111 that attaches the left simulated hand 114 to the left simulated lower arm 113. The left simulated hand 114 is the structure of the left simulated arm structure 111 that generates the sentiment of the left hand of a human being. The left simulated hand 114 attaches to the end of the left simulated lower arm 113 that is distal from the left simulated upper arm 112.

The right simulated arm structure 121 has the rough primary shape of a composite prism. The right simulated arm structure 121 attaches to the right shoulder region of the torso structure 102 such that the right simulated arm structure 121 rotates relative to the torso structure 102. The right simulated arm structure 121 generates the sentiment of the right arm of a human being. The right simulated arm structure 121 further comprises a right simulated upper arm 122, a right simulated lower arm 123, and a right simulated hand 124.

The right simulated upper arm 122 is the structure of the right simulated arm structure 121 that attaches the right simulated lower arm 123 to the torso structure 102. The right simulated lower arm 123 is the structure of the right simulated arm structure 121 that attaches the right simulated hand 124 to the right simulated lower arm 123. The right simulated hand 124 is the structure of the right simulated arm structure 121 that generates the sentiment of the right hand of a human being. The right simulated hand 124 attaches to the end of the right simulated lower arm 123 that is distal from the right simulated upper arm 122.

The left simulated leg structure 131 has the rough primary shape of a prism. The left simulated leg structure 131 rigidly 22 attaches to the inferior end of the left telescopic structure 162 of the left telescopic knee 161. The left simulated leg structure 131 generates the sentiment of the lower left leg of a human being. The left simulated leg structure 131 further comprises a left simulated foot 132 and a left plurality of casters 133.

The left simulated foot 132 is a pedestal structure that attaches to the end of the left simulated leg structure 131 that is distal from the left telescopic knee 161. The left simulated foot 132 transfers a portion of the load of the invention 100 to the left plurality of casters 133. The left simulated foot 132 generates the sentiment of the left foot of a human being. The left plurality of casters 133 is a rolling structure that mounts on the inferior surface of the left simulated foot 132. The left plurality of casters 133 rolls the invention 100 over the supporting surface. The left plurality of casters 133 transfers a portion of the load of the invention 100 to the supporting surface.

The right simulated leg structure 141 has the rough primary shape of a prism. The right simulated leg structure 141 rigidly attaches to the inferior end of the right telescopic structure of the right telescopic knee 171. The right simulated leg structure 141 generates the sentiment of the lower left leg of a human being. The right simulated leg structure 141 further comprises a right simulated foot 142 and a right plurality of casters 143.

The right simulated foot 142 is a pedestal structure that attaches to the end of the right simulated leg structure 141 that is distal from the right telescopic knee 171. The right simulated foot 142 transfers the balance of the load of the invention 100 to the right plurality of casters 143. The right simulated foot 142 generates the sentiment of the left foot of a human being. The right plurality of casters 143 is a rolling structure that mounts on the inferior surface of the right simulated foot 142. The right plurality of casters 143 rolls the invention 100 over the supporting surface. The right plurality of casters 143 transfers the balance of the load of the invention 100 to the supporting surface.

Each joint selected from the plurality of joints 105 is a fastening device. Each joint selected from the plurality of joints 105 is a rotating device. Each joint selected from the plurality of joints 105 forms an attachment selected from the group consisting of: a) attaching the head structure 101 to the torso structure 102; b) attaching the pelvic structure 103 to the torso structure 102; c) attaching an appendage structure selected from the group consisting of left simulated arm structure 111 and the right simulated arm structure 121 to the torso structure 102. Each joint selected from the plurality of joints 105 is a rotating joint. The attachment formed by each joint selected from the plurality of joints 105 is a rotating joint. The attachment formed by each joint selected from the plurality of joints 105 rotates with a limited arc rotation. The plurality of joints 105 comprises a neck joint 151, a waist joint 152, a left shoulder joint 153, a right shoulder joint 154, a right shoulder joint 154, and a left elbow 155.

The neck joint 151 is a fastening device. The neck joint 151 is a rotating device. The neck joint 151 rotates over a limited arc rotation. The neck joint 151 is a locking joint. The neck joint 151 secures the head structure 101 to the torso structure 102 such that the head structure 101 rotates relative to the torso structure 102 over a limited arc rotation.

The waist joint 152 is a fastening device. The waist joint 152 is a rotating device. The waist joint 152 rotates over a limited arc rotation. The waist joint 152 is a locking joint. The waist joint 152 secures the pelvic structure 103 to the torso structure 102 such that the pelvic structure 103 rotates relative to the torso structure 102 over a limited arc rotation.

The left shoulder joint 153 is a fastening device. The left shoulder joint 153 is a rotating device. The left shoulder joint 153 rotates over a limited arc rotation. The left shoulder joint 153 is a locking joint. The left shoulder joint 153 secures the left simulated upper arm 112 of the left simulated arm structure 111 to the torso structure 102 such that the left simulated upper arm 112 rotates relative to the torso structure 102 over a limited arc rotation.

The right shoulder joint 154 is a fastening device. The right shoulder joint 154 is a rotating device. The right shoulder joint 154 rotates over a limited arc rotation. The right shoulder joint 154 is a locking joint. The right shoulder joint 154 secures the right simulated upper arm 122 of the right simulated arm structure 121 to the torso structure 102 such that the right simulated upper arm 122 rotates relative to the torso structure 102 over a limited arc rotation.

The left elbow 155 is a fastening device. The left elbow is a rotating device. The left elbow 155 rotates over a limited arc rotation. The left elbow 155 is a locking joint. The left elbow 155 secures the left simulated lower arm 113 to the left simulated upper arm 112 such that the left simulated lower arm 113 rotates relative to the left simulated upper arm 112 over a limited arc rotation.

The right elbow 156 is a fastening device. The right elbow is a rotating device. The right elbow 156 rotates over a limited arc rotation. The right elbow 156 is a locking joint. The right elbow 156 secures the right simulated lower arm 123 to the right simulated upper arm 122 such that the right simulated lower arm 123 rotates relative to the right simulated upper arm 122 over a limited arc rotation.

Each telescopic knee structure selected from the plurality of telescopic knee structures 106 is a fastening device. Each telescopic knee structure selected from the plurality of telescopic knee structures 106 attaches an appendage structure selected from the group consisting of: a) the left simulated leg structure 131; and, b) the right simulated leg structure 141 to the pelvic structure 103. Each telescopic knee structure selected from the plurality of telescopic knee structures 106 is a telescopic device. Each telescopic knee structure selected from the plurality of telescopic knee structures 106 is an extension structure. Each telescopic knee structure selected from the plurality of telescopic knee structures 106 bridges the reach between the pelvic structure 103 and the selected appendage such that the reach of the bridge is adjustable. The elevation of the head structure 101 above the supporting surface is adjustable. The elevation of the head structure 101 adjusts by adjusting the reach of the bridge. The plurality of telescopic knee structures 106 comprises a left telescopic knee 161 and a right telescopic knee 171.

The left telescopic knee 161 is a fastening device. The left telescopic knee 161 permanently attaches the left simulated leg structure 131 to the pelvic structure 103. The left telescopic knee 161 forms an extension structure that bridges the reach between the left simulated leg structure 131 and the pelvic structure 103. The left telescopic knee 161 is an extensible structure. By extensible structure is meant that the span of the length of the bridge formed by the left telescopic knee 161 is adjustable. The left telescopic knee 161 further comprises a left telescopic structure 162 and a left shell structure 163.

The left telescopic structure 162 is the mechanical structure that forms the bridge between the left simulated leg structure 131 and the pelvic structure 103. The left telescopic structure 162 is a telescopic structure. The reach of the bridge of the left telescopic knee 161 adjusts by adjusting the span of the length of the left telescopic structure 162. The left shell structure 163 is a shell that encloses the left telescopic structure 162. The left shell structure 163 generates the sentiment that the left knee of a human being.

The right telescopic knee 171 is a fastening device. The right telescopic knee 171 permanently attaches the right simulated leg structure 141 to the pelvic structure 103. The right telescopic knee 171 forms an extension structure that bridges the reach between the right simulated leg structure 141 and the pelvic structure 103. The right telescopic knee 171 is an extensible structure. By extensible structure is meant that the span of the length of the bridge formed by the right telescopic knee 171 is adjustable. The right telescopic knee 171 further comprises a right telescopic structure 172 and a right shell structure 173.

The right telescopic structure 172 is the mechanical structure that forms the bridge between the right simulated leg structure 141 and the pelvic structure 103. The right telescopic structure 172 is a telescopic structure. The reach of the bridge of the right telescopic knee 171 adjusts by adjusting the span of the length of the right telescopic structure 172. The right shell structure 173 is a shell that encloses the right telescopic structure 172. The right shell structure 173 generates the sentiment that the right knee of a human being.

The shoulder lever structure 107 is a mechanical structure. The shoulder lever structure 107 is a rotating structure. The shoulder lever structure 107 attaches the left shoulder joint such that the rotation of the shoulder lever structure 107 rotates the left shoulder joint 153. The shoulder lever structure 107 attaches the right shoulder joint 154 such that the rotation of the shoulder lever structure 107 rotates the right shoulder joint 154. The shoulder lever structure 107 rotates the right shoulder joint 154 in the same direction and through the same arc of rotation as the left shoulder joint 153. The shoulder lever structure 107 provides a mechanical advantage that allows the patient the rotate the left simulated arm structure 111 and the right simulated arm structure 121 a position that hugs the patient 109. The shoulder lever structure 107 comprises a shoulder beam structure 181 and a shoulder grip structure 182.

The shoulder beam structure 181 is a rigid prism shaped structure. The shoulder beam structure 181 physically attaches the left shoulder joint 153 to the right shoulder joint 154. The shoulder beam structure 181 attaches to the left shoulder joint 153 and the right shoulder joint 154 such that the rotation of the center axis of the shoulder beam structure 181 rotates both the left shoulder joint 153 and the right shoulder joint 154. The shoulder beam structure 181 rotates the left shoulder joint 153 and the right shoulder joint 154 in both the same direction and over the same arc of rotation.

The shoulder grip structure 182 is a rigid prism shaped structure that attaches to the lateral face of the shoulder beam structure 181. The shoulder grip structure 182 forms a lever that is used to rotate the shoulder beam structure 181 around a center of rotation that is aligned with the center axis of the shoulder beam structure 181.

Definitions and Directional References

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

Appendage: As used in this disclosure, appendage is a generic term used to describe one or more limbs of a patient. An appendage that primarily transfers the load of the patient to a supporting surface is referred to as a leg. An appendage without this primary purpose is referred to as an arm. The term limb is a synonym for appendage.

Arc: As used in this disclosure, an arc refers to a portion of a circumference or a curved perimeter. When applied to an angle or cant, the arc also refers to a measure of an angular span as measured from a circle at the vertex formed by the sides of the angle.

Articulated: As used in this disclosure, articulated refers to two objects that are joined together using a hinge or a flexible joint such that the first object moves relative to the second object. A structure that contains an articulated sub-component is referred to as an articulated structure.

Bridge: As used in this disclosure, a bridge refers to a load bearing structure that attaches a first object and to a second object such that a load bearing path is formed between the first object and the second object. The verb "to bridge" means to establish a connection (or remove a disconnection) between a first object and a second object.

Cant: As used in this disclosure, a cant is an angular deviation from one or more reference lines (or planes) such as a vertical line (or plane) or a horizontal line (or plane).

Caster: As used in this disclosure, a caster is a wheel that is mounted on a swivel that allows the wheel to adjust, or swivel, the direction of rotation of the wheel to the direction of motion desired for the wheel. The generic parts of a caster are called the stem, the swivel bearing, the swivel mount and the wheel. The swivel bearing attaches the stem to the swivel mount such that the swivel mount will rotate relative to the stem. The wheel attaches to the swivel mount such that the wheel freely rotates relative to the swivel mount. The direction of the axis of rotation of the wheel is perpendicular to the direction of the axis of rotation of the swivel mount. The stem attaches the swivel bearing, the swivel mount, and the wheel to an externally provided object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is a structure formed from a pad that is used to prevent injury or damage to a person or object.

Distal and Proximal: As used in this disclosure, the terms distal and proximal refers to a directional sense or location relative to the medial axis of the body. When comparing the location of a first object relative to a second object, when the minimum span of the distance between the first object and the medial axis is greater than the minimum span of the distance between the second object and the medial axis, the first object is said to be the distal object or the object distal from the medial axis. Alternately, when the minimum span of the distance between the first object and the medial axis is lesser than the minimum span of the distance between the second object and the medial axis, the first object is said to be the proximal object or the object proximal to the medial axis.

Exterior: As used in this disclosure, the exterior is used as a relational term that implies that an object is not contained within the boundary of a structure or a space.

Form Factor: As used in this disclosure, the term form factor refers to the size and shape of an object.

Extremity: As used in this disclosure, extremity is a generic term used to describe either the hand and/or foot of a person. The extremity is located and the distal end of an appendage.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Extensible: As used in this disclosure, extensible is an adjective that describes an object made of sections that fit or together such that the object can be made longer or shorter by adjusting the relative positions of the sections.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Finger: As used in this disclosure, a finger is the portion of the hand that encloses the proximal phalange bone and its associated distal phalange bone of a hand. The fingernail is a claw like structure that is formed at the distal end of the finger. The finger of the hand that is formed without an intermediate phalange bone is referred to as the thumb. When sequentially numbering the fingers of the hand, the thumb is taken to be the first finger.

Figurine: As used in this disclosure, a figurine is a three dimensional structure resembling (or representing) a human, animal, natural, or symbolic sentiment.

Force of Gravity: As used in this disclosure, the force of gravity refers to a vector that indicates the direction of the pull of gravity on an object at or near the surface of the earth.

Foot: As used in this disclosure, the foot refers to the portion of the leg that is below the ankle. Within this disclosure, the foot is further defined with a forefoot, a midfoot, a hindfoot, and a sole. The forefoot is the region of the foot is the anterior portion of the foot within which the phalanges and the metatarsals bones are located. The midfoot is the region of the foot within which the navicular, cuboid, and cuneiform bones are located. The hindfoot is the region of the foot that is posterior to the midfoot. The sole refers to the inferior surfaces of the foot located underneath the forefoot, the midfoot, and the hindfoot. The human foot further comprises five toes formed at the distal end of the forefoot.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Grip: As used in this disclosure, a grip is an accommodation formed on or within an object that allows the object to be grasped or manipulated by a hand.

Ground: As used in this disclosure, the ground is a solid supporting surface formed by the Earth. The term level ground means that the supporting surface formed by the ground is roughly perpendicular to the force of gravity. The term underground refers to an object being underneath the superior surface of the ground.

Hand: As used in this disclosure, the hand is the extremity of the arm. The hand attaches to the wrist at the end that is distal from the shoulder. The hand comprises a plurality of metacarpal bones and a plurality of phalange bones.

Head: As used in this disclosure, the head refers to the structures of a body that are associated with a skull.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Image: As used in this disclosure, an image is an optical representation or reproduction of an indicia or of the appearance of something or someone.

Indicia: As used in this disclosure, the term indicia refers to a set of markings that identify a sentiment. See sentiment.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Limited Arc Rotation: As used in this disclosure, a limited arc rotation refers the rotation of a structure that: a) has a rotation that allows the reversal of the direction of rotation of the structure; and, b) has an arc of rotation of less than 360 degrees.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Joint: As used in this disclosure, a joint refers to the attachment of a first bone of a body to a second bone of the body such that the first bone is able to rotate relative to the second bone.

Joint: As used in this disclosure, a joint refers to a structure that joins a first manufactured structure to a second manufactured structure. A joint that can be locked into position is called a locking joint.

Lateral: As used in this disclosure, lateral refers to a directional sense or location of the body. Specifically, lateral refers to an object or a side of an object that is proximal to the side or that is distal from the medial axis of the body. The lateral direction movement is always perpendicular to the anterior posterior axis. Lateral movement is often called sideways movement.

Left and Right: As used in this disclosure, the terms left and right are directional references associated with an object. The object is further defined with an anterior surface and a posterior surface. The terms left and right are standardized naming conventions for the lateral directions of the object. The terms left and right use the human body for the initial definition of the orientation. Specifically, when a human body is viewed from posterior side towards the anterior side, the left side of the human body is the lateral side of the human body that contains the heart. The right side of the human body is the lateral side of the body that contains the bulk of the liver. The left and right sides of the human body remain unchanged by changes to the direction from which the human body is viewed. The left side of any object is the same side as the left side of the human body when the object is viewed is viewed from posterior side towards the anterior side. The right side of any object is the same side as the right side of the human body when the object is viewed is viewed from posterior side towards the anterior side. The left and right sides of the object remain unchanged by changes to the direction from which the object is viewed.

Lever: As used in this disclosure, a lever is a device that comprises a shaft that rotates around a fulcrum, axis of rotation, or pivot point. Levers are known for generating a mechanical advantage, known as leverage, when they are used to provide rotational force into a rotating mechanical system or device. A lever is an example of a simple machine.

Mechanical Advantage: As used in this disclosure, mechanical advantage is a measure of the ratio of the force generated by a mechanical device divided by force applied to the mechanical device. The leverage generated by a lever is an example of mechanical advantage. Typically, a mechanical advantage will amplify the force input into the mechanical device but does not impact the energy transfers through the mechanical device.

Medial: As used in this disclosure, medial refers to a directional sense or location of the body. Specifically, medial refers to a first object or a side of a first object that is closer to the medial axis or more distal from the side of the body relative to a second object or side of a second object.

Medial Axis: As used in this disclosure, the medial axis is the center line of the body as the line is drawn from the head to the foot. When two objects are compared relative to the medial axis, the object closer to the medial axis is referred to as the medial object and the object distal from the medial axis is referred to as the lateral object.

Metacarpal Bone: As used in this disclosure, the metacarpal bone refers to one of several bones of the hand that are enclosed by the palm of the hand. The metacarpal bones attach the bones of the wrist to the phalange bones of the fingers.

Neck: As used in this disclosure, the neck refers to the portion of a biological entity that attaches the head of the biological entity to the torso of the biological entity.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Palm: As used in this disclosure, the palm of the hand is identified as the portions of a left hand and a right hand between the fingers and the wrist that contact each other when the left hand presses against the right hand when the left hand and right hand are in alignment. The palm encloses the metacarpal bones of the hand. The palm of the left hand is the mirror image of the palm of the right hand. The palm encloses the metacarpal bones of the hand.

Patient: As used in this disclosure, a patient is a person who is designated to receive a medical treatment, therapy or service. The term patient may be extended to an animal when used within the context of the animal receiving veterinary treatment or services.

Pedestal: As used in this disclosure, a pedestal is an intermediary load bearing structure that forms a load path between two objects or structures.

Pelvis: As used in this disclosure, the pelvis refers to a bone structure near the base of the spine to which buttocks and the legs are joined. As used in this disclosure, the term pelvis is a more generally expanded to describe the above described region of the body. As used in this disclosure, the adjectival form of pelvis is pelvic.

Perimeter: As used in this disclosure, a perimeter is one or more curved or straight lines that bounds an enclosed area on a plane or surface. The perimeter of a circle is commonly referred to as a circumference.

Phalange Bone: As used in this disclosure, the phalange bone refers to one of several bones of the hand that are enclosed by the fingers of the hand.

Posterior: As used in this disclosure, posterior is a term that is used to refer to the side of an object that is distal or in the opposite direction of the anterior side. When comparing two items, the posterior item is the item that is distal from the anterior of the object.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Puppet: As used in this disclosure, a puppet is a three-dimensional figure resembling a human, animal or symbolic image. A puppet is often called a doll.

Reach: As used in this disclosure, reach refers to a span of distance between any two objects.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Sentiment: As used in this disclosure, a sentiment refers to a symbolic meaning or message that is communicated through the use of an object or an image, potentially including a text based image.

Simulation: As used in this disclosure, a simulation refers to an environment that imitates a physical process. The verb form of simulation is to simulate.

Skin: As used in this disclosure, the skin is an organ that forms the exterior surfaces of an animal. The skin forms a barrier that protects the biological organs of the animal from the environment. The skin is formed from three layers of tissue known as the epidermis, the dermis, and the hypodermis. The epidermis is the layer of the skin that is exposed to the environment. The dermis forms the layer of tissue between the epidermis and the hypodermis. The dermis contains blood vessels, nerves, and glands the lubricate the exterior surface of the epidermis. The hypodermis attaches the dermis to the musculature and bones of the body. The hypodermis forms the structures that shape the body. The hypodermis contains the sweat glands. The macrophages of the immune system are also commonly found in the hypodermis. The body further uses the hypodermis for fat storage. The hypodermis is also referred to as the subcutaneous layer of the skin. The depth of the skin ranges from 1 mm to 4 mm. The depth of the skin varies by the location on the body.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Swivel: As used in this disclosure, a swivel is a fastening structure that attaches a first object to a second object such that will rotate around an axis of rotation while the second object remains in a fixed position relative to the first object.

Telescopic: As used in this disclosure, telescopic is an adjective that describes a composite prism structure made of hollow prism-shaped sections that fit or slide into each other such that the center axis of the composite prism structure can be made longer or shorter by adjusting the relative positions of the hollow prism-shaped sections.

Therapeutic: As used in this disclosure, therapeutic is an adjective that refers to a medical, ameliorative, or hygienic substance, process, procedure, or device.

Torso: As used in this disclosure, the torso refers to the portion of a human body between the neck and the pelvis. The spine is primarily contained within the torso.

Universal Joint: As used in this disclosure, a universal joint is a method of joining a first shaft to as second shaft such that the center axis of the first shaft and is offset from the center axis of the second shaft. The offset angle is adjustable. When a universal joint is formed with a locking mechanism, a universal joint can further be used to lock the offset angle, often referred to as a cant, between the first shaft and the second shaft into a fixed position. Universal joints are often used to transfer rotation from the first shaft to rotate the second shaft.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Waist: As used in this disclosure, the waist refers to the perimeter around the abdomen of a person. Traditionally, the perimeter formed by the waist is closer to the hips than the ribs of the person.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction. Wheels are often further defined with a rim and spokes. Spokes are also commonly referred to as a wheel disk.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A therapy doll comprising wherein the therapy doll comprises a head structure, a torso structure, a pelvic structure, a plurality of simulated appendage structures, a plurality of joints, a plurality of telescopic knee structures, a shoulder lever structure, and a simulated skin structure;

wherein the plurality of joints and the plurality of telescopic knee structures assemble the head structure, the torso structure, the pelvic structure, and the plurality of simulated appendage structures into a figurine that presents the sentiment of a human being;

wherein the shoulder lever structure mounts in the torso structure and comprises a handle extending solely from a rear of the torso structure;

wherein the simulated skin structure encloses the exterior surfaces of the figurine formed by the therapy doll;

wherein the therapy doll is an emotional support doll that is formed in the image of a human being, and is adapted to provide a patient with a hug;

wherein the plurality of joints comprises a left shoulder joint, and a right shoulder joint;

wherein the shoulder lever structure attaches the left shoulder joint such that the rotation of the shoulder lever structure rotates the left shoulder joint;

wherein the shoulder lever structure attaches the right shoulder joint such that the rotation of the shoulder lever structure rotates the right shoulder joint;

wherein the shoulder lever structure rotates the right shoulder joint in the same direction and through a same limited arc rotation as the left shoulder joint;

wherein the shoulder lever structure provides a mechanical advantage that is adapted to allow the patient the ability to manually rotate the left simulated arm structure and the right simulated arm structure to a position that is adapted to hug the patient.

2. The therapy doll according to claim 1 wherein the simulated skin structure is a cushioned surface that encloses the exterior surfaces of the figurine structure formed by the therapy doll;

wherein the simulated skin structure coats the exterior surfaces of the head structure;

wherein the simulated skin structure coats the exterior surfaces of the torso structure;

wherein the simulated skin structure coats the exterior surfaces of the pelvic structure;

wherein the simulated skin structure coats the exterior surfaces of each simulated appendage structure selected from the plurality of simulated appendage structures;

wherein the simulated skin structure coats the exterior surfaces of the shell structure of each telescopic knee structure selected from the plurality of telescopic knee structures.

3. The therapy doll according to claim 2 wherein the head structure is a mechanical structure;

wherein the appearance of the head structure generates the sentiment of the head of a human being;

wherein the torso structure is a mechanical structure;

wherein the appearance of the torso structure generates the sentiment of the torso of a human being;

wherein the pelvic structure is a mechanical structure;

wherein the appearance of the pelvic structure generates the sentiment of the pelvis of a human being.

4. The therapy doll according to claim 3 wherein each simulated appendage structure selected from the plurality of simulated appendage structures attaches to a structure selected from the group consisting of the head structure and the torso structure;

wherein each simulated appendage structure selected from the plurality of simulated appendage structures attaches to its selected structure such that the selected simulated appendage structure rotates relative to the selected structure;

wherein the appearance of each simulated appendage structure selected from the plurality of simulated appendage structures generates the sentiment of the appendage of a human being.

5. The therapy doll according to claim 4 wherein each joint selected from the plurality of joints is a fastening device;

wherein each joint selected from the plurality of joints is a rotating device;

wherein each joint selected from the plurality of joints forms an attachment selected from the group consisting of: a) attaching the head structure to the torso structure; b) attaching the pelvic structure to the torso structure; c) attaching an appendage structure selected from the group consisting of left simulated arm structure and the right simulated arm structure to the torso structure.

6. The therapy doll according to claim 5 wherein each telescopic knee structure selected from the plurality of telescopic knee structures is a fastening device;

wherein each telescopic knee structure selected from the plurality of telescopic knee structures attaches an appendage structure selected from the group consisting of: a) the left simulated leg structure; and, b) the right simulated leg structure to the pelvic structure;

wherein each telescopic knee structure selected from the plurality of telescopic knee structures is a telescopic device;

wherein each telescopic knee structure selected from the plurality of telescopic knee structures is an extension structure;

wherein each telescopic knee structure selected from the plurality of telescopic knee structures configures a bridge that reaches between the pelvic structure and the selected appendage to be adjustable.

7. The therapy doll according to claim 6 wherein the plurality of simulated appendage structures comprises a left simulated arm structure, a right simulated arm structure, a left simulated leg structure, and a right simulated leg structure;

wherein the left simulated arm structure has the primary shape of a composite prism;

wherein the left simulated arm structure attaches to the left shoulder region of the torso structure such that the left simulated arm structure rotates relative to the torso structure;

wherein the left simulated arm structure generates the sentiment of the left arm of a human being;

wherein the right simulated arm structure has the primary shape of a composite prism;

wherein the right simulated arm structure attaches to the right shoulder region of the torso structure such that the right simulated arm structure rotates relative to the torso structure;

wherein the right simulated arm structure generates the sentiment of the right arm of a human being;

wherein the left simulated leg structure has the primary shape of a prism;

wherein the left simulated leg structure rigidly attaches to an inferior end of the left telescopic structure of the left telescopic knee;

wherein the left simulated leg structure generates the sentiment of the lower left leg of a human being;

wherein the right simulated leg structure has the primary shape of a prism;

wherein the right simulated leg structure rigidly attaches to an inferior end of the right telescopic structure of the right telescopic knee;

wherein the right simulated leg structure generates the sentiment of the lower left leg of a human being.

8. The therapy doll according to claim 7 wherein the plurality of joints comprises a neck joint, a waist joint, the left shoulder joint, the right shoulder joint, a right elbow, and a left elbow;

wherein the neck joint is a fastening device;

wherein the neck joint secures the head structure to the torso structure;

wherein the waist joint is a fastening device;

wherein the waist joint secures the pelvic structure to the torso structure;

wherein the left shoulder joint is a fastening device;

wherein the left shoulder joint is a rotating device;

wherein the left shoulder joint secures the left simulated arm structure to the torso structure such that the left simulated upper arm rotates relative to the torso structure;

wherein the right shoulder joint is a fastening device;

wherein the right shoulder joint is a rotating device;

wherein the right shoulder joint secures the right simulated arm structure to the torso structure such that the right simulated upper arm rotates relative to the torso structure;

wherein the left elbow is a fastening device;
wherein the left elbow is a rotating device;
wherein the left elbow mounts in the left the left simulated upper arm such that the left simulated arm rotates;
wherein the right elbow is a fastening device;
wherein the right elbow is a rotating device;
wherein the right elbow secures the right simulated upper arm such that the right simulated arm rotates.

9. The therapy doll according to claim 8,
wherein the plurality of telescopic knee structures comprises a left telescopic knee and a right telescopic knee;
wherein the left telescopic knee is a fastening device;
wherein the left telescopic knee permanently attaches the left simulated leg structure to the pelvic structure;
wherein the left telescopic knee forms an extension structure that bridges the reach between the left simulated leg structure and the pelvic structure;
wherein the left telescopic knee is an extensible structure;
wherein by extensible structure is meant that the span of the length of the bridge formed by the left telescopic knee is adjustable;
wherein the right telescopic knee is a fastening device;
wherein the right telescopic knee permanently attaches the right simulated leg structure to the pelvic structure;
wherein the right telescopic knee forms an extension structure that bridges the reach between the right simulated leg structure and the pelvic structure;
wherein the right telescopic knee is an extensible structure;
wherein by extensible structure is meant that the span of the length of the bridge formed by the right telescopic knee is adjustable.

* * * * *